US008038632B2

(12) United States Patent
Flick et al.

(10) Patent No.: US 8,038,632 B2
(45) Date of Patent: Oct. 18, 2011

(54) VIBRATIONAL AND PULSATING CUSHION DEVICE

(75) Inventors: Roland E. Flick, Elma, NY (US); Raymond P. Paolini, Orchard Park, NY (US); Jeffery Joseph Thompson, Portage, MI (US)

(73) Assignee: Stryker Corporation, Kalamazoo, MI (US)

( * ) Notice: Subject to any disclaimer, the term of this patent is extended or adjusted under 35 U.S.C. 154(b) by 965 days.

(21) Appl. No.: 11/963,911

(22) Filed: Dec. 24, 2007

(65) Prior Publication Data

US 2008/0097259 A1 Apr. 24, 2008

Related U.S. Application Data

(62) Division of application No. 10/728,498, filed on Dec. 5, 2003, now Pat. No. 7,322,947.

(60) Provisional application No. 60/457,638, filed on Mar. 26, 2003, provisional application No. 60/498,088, filed on Aug. 27, 2003.

(51) Int. Cl.
*A61H 1/00* (2006.01)

(52) U.S. Cl. ..... 601/46; 601/55; 601/56

(58) Field of Classification Search ..... 601/13, 601/41, 44, 46, 48, 49, 55, 56, 149, 151–152; 5/15, 630, 706
See application file for complete search history.

(56) References Cited

U.S. PATENT DOCUMENTS 766,746 A 7/1904 Miner
843,674 A 2/1907 Funk
1,355,679 A 10/1920 McConnell
2,338,339 A 1/1944 La Mere et al.
3,394,415 A 7/1968 Parker
3,596,077 A 7/1971 Miazga
3,829,914 A 8/1974 Treat
(Continued)

FOREIGN PATENT DOCUMENTS

DE 19952822 A 3/2001
(Continued)

OTHER PUBLICATIONS

EPO search report of corresponding application.

*Primary Examiner* — Michael A. Brown
(74) *Attorney, Agent, or Firm* — Warner Norcross & Judd LLP

(57) ABSTRACT

The present invention is a vibratory patient support system. The support system has at least one bladder, at least one vibrational device, and first and second control units that respectively control (a) the inflation and deflation of the at least one bladder and (b) vibrational device. The at least one bladder (i) inflates when receiving a fluid at a faster rate than the fluid exiting the bladder; (ii) deflates when the fluid leaves the bladder at a faster rate than the fluid entering the bladder, and (iii) has a top surface that allows a user to apply pressure thereon and a bottom surface. The vibrational device (a) is positioned (i) under the bottom surface of the bladder, or (ii) within the bladder and below the top surface of the at least one bladder so it does not contact the top surface; and (b) generates a vibrational force. The first control unit can adjust the inflation of the at least one bladder. The second control unit can adjust the vibration forces generated from the vibration device. The first and second control units can operate in conjunction with each other to provide the desired vibrational application to the user.

12 Claims, 8 Drawing Sheets

U.S. PATENT DOCUMENTS 3,831,250 A 8/1974 Holiday
3,962,736 A 6/1976 Fedele
4,057,861 A 11/1977 Howorth
4,091,804 A 5/1978 Hasty
4,105,024 A 8/1978 Raffel
4,280,487 A 7/1981 Jackson
4,416,293 A 11/1983 Anderson et al.
4,597,384 A 7/1986 Whitney
4,675,925 A 6/1987 Littleton
4,744,115 A 5/1988 Marchione
4,884,304 A 12/1989 Elkins
4,947,500 A 8/1990 Seiler
5,010,608 A 4/1991 Barnett et al.
5,014,687 A 5/1991 Raffel
5,140,977 A 8/1992 Raffel
5,142,720 A * 9/1992 Kelso et al. ..... 5/630
5,150,487 A 9/1992 Hemphill
5,189,282 A 2/1993 Rocha et al.
5,216,768 A 6/1993 Bodine et al.
5,280,657 A 1/1994 Stagg
5,314,055 A 5/1994 Gordon
5,329,655 A 7/1994 Garner
5,394,577 A 3/1995 James et al.
5,452,180 A 9/1995 Register et al.
5,469,588 A 11/1995 DiMatteo et al.
5,499,932 A 3/1996 Tanaka et al.
5,530,974 A 7/1996 Rains et al.
5,540,321 A 7/1996 Foster
5,569,170 A 10/1996 Hansen
5,586,346 A 12/1996 Stacy et al.
5,606,754 A 3/1997 Hand
5,611,096 A 3/1997 Bartlett et al.
5,630,238 A 5/1997 Weismiller et al.
5,638,558 A 6/1997 Moore
5,695,455 A 12/1997 Alton, Jr. et al.
5,697,109 A 12/1997 Hodgetts
5,715,548 A 2/1998 Weismiller et al.
5,730,707 A 3/1998 Vang
5,737,781 A 4/1998 Votel
5,742,958 A 4/1998 Solazzo
5,781,949 A 7/1998 Weismiller et al.
5,794,289 A 8/1998 Wortman et al.
5,876,359 A 3/1999 Bock et al.
5,926,002 A 7/1999 Cavanaugh et al.
5,926,883 A * 7/1999 Rechin et al. ..... 5/706
5,926,884 A 7/1999 Biggie et al.
5,983,429 A 11/1999 Stacy et al.
6,047,424 A 4/2000 Osborne et al.
6,079,065 A 6/2000 Luff
6,079,070 A 6/2000 Flick
6,094,758 A 8/2000 Renfro
6,098,222 A 8/2000 Hand et al.
6,119,291 A 9/2000 Osborne et al.
6,119,292 A * 9/2000 Haas ..... 5/715
6,163,908 A 12/2000 Vrzalik
6,203,105 B1 3/2001 Rhodes, Jr.
6,273,735 B1 8/2001 Johnson et al.
6,295,675 B1 10/2001 Ellis et al.
6,311,348 B1 11/2001 Luff et al.
6,336,235 B1 1/2002 Ruehl
6,378,152 B1 4/2002 Washburn et al.
6,396,224 B1 5/2002 Luff et al.
6,467,113 B2 10/2002 Ellis et al.
6,493,888 B1 12/2002 Salvatini et al.
6,584,628 B1 7/2003 Kummer et al.
6,683,786 B2 1/2004 Yin et al.
6,695,798 B2 2/2004 Chang
6,892,405 B1 5/2005 Dimitriu et al.
7,076,818 B2 7/2006 Kummer et al.
7,402,146 B2 7/2008 Wu
7,406,736 B2 8/2008 Flick
7,418,751 B1 9/2008 Bartlett et al.
7,465,280 B2 12/2008 Rawls-Meehan
7,540,748 B2 6/2009 Tracy et al.
7,679,901 B2 3/2010 Lin
2002/0016559 A1 2/2002 Cutler et al.
2002/0091340 A1 7/2002 Robbins
2002/0111572 A1 8/2002 Waters
2002/0124320 A1 9/2002 Washburn et al.
2003/0084511 A1 5/2003 Salvatini et al.
2004/0261184 A1 12/2004 Flick
2006/0037130 A1 2/2006 Graham
2006/0101581 A1 5/2006 Blanchard et al.
2007/0209119 A1 9/2007 Chun-Chu
2008/0097259 A1 4/2008 Flick et al.
2009/0069731 A1 3/2009 Parish et al.
2009/0193586 A1 8/2009 L'Hegarat et al.
2009/0237264 A1 9/2009 Bobey et al.
2009/0270774 A1 10/2009 Gowda et al.
2009/0299239 A1 12/2009 Meyer et al.
2010/0071137 A1 3/2010 Doehler et al.

FOREIGN PATENT DOCUMENTS

DE 199 49 474 A1 4/2001
WO WO 03/015686 A1 2/2003

* cited by examiner

VIBRATIONAL AND PULSATING CUSHION DEVICE

CLAIM OF PRIORITY

This application claims priority to U.S. patent application Ser. No. 10/728,498, filed on Dec. 5, 2003 (now allowed), which claims priority to U.S. Provisional Patent application Ser. No. 60/457,638, filed on Mar. 26, 2003; and U.S. Provisional Patent application Ser. No. 60/498,088, filed on Aug. 27, 2003.

FIELD OF THE INVENTION

The present invention relates to a cushioning device. Examples of such cushioning devices include and are not limited to mattresses and mattress overlays.

BACKGROUND OF THE PRESENT INVENTION

In U.S. Pat. No. 5,606,754; Hand et al. disclose "a vibratory patient support system for providing therapeutic vibrational action or forces to a patient suffering from a respiratory ailment. The vibratory patient support system includes a rigid support frame such as a bed frame, [and] a plurality of inflatable sacs supported upon the support frame with each sac having an upper surface so that the plurality of sacs [sic] forms a patient support surface. The inflatable sacs are pressurized and maintained at a predetermined pressure. This predetermined pressure may be a patient height and weight specific pressure profile. A vibrating component is provided separate from the apparatus for pressurizing and maintaining the air sacs at the predetermined pressure. The vibrating component vibrates at least a portion of the patient support surface at a predetermined frequency. In this manner, the plurality of air sacs are maintained at their predetermined pressure and the portion of the patient support surface [sic] is simultaneously vibrated at the predetermined frequency. The vibrating means are further variably controllable so that an operator can vary the frequency, magnitude or amplitude, and duration of the vibrating therapy. The vibratory patient support system may include a specialty low air loss bed configuration including vibrating means for vibrating a portion of the patient support surface of the low air loss sacs at the predetermined frequency." See the abstract of the '754 patent.

Hand et al.'s system has vibrating devices that create vibrational and/or pulsating forces within or outside the inflatable sacs. In every embodiment in the '754 patent, the vibrating devices are adjacent or contacting the patient support surface. That means, Hand et al. teach that those devices must be positioned over the inflatable sac to operate effectively. To obtain a correct position for the vibrating devices, Hand et al. disclose that the sacs could contain supports therein. The supports position those devices adjacent to the patient support surface.

According to Hand et al., at least one inflatable sac must be inflated at a predetermined pressure. The predetermined pressure is dependent on at least the patient's weight and/or height, not on the vibrational force applied to the patient.

As previously stated, Hand et al. disclose that those vibrational and/or pulsating force devices should be positioned above the inflatable sacs. That way, there is little chance of the devices falling away from the patient support surface. This method of applying vibrational forces, however, is not always practical. For example, positioning one of those vibrational and/or pulsating force devices so it contacts a patient may result in pinching and/or bruising the patient's skin or applying too many vibrational forces to the user. Obviously, such results could be deleterious. The present invention solves these problems.

SUMMARY OF THE INVENTION

The present invention is a vibratory patient support system. The support system has at least one bladder, at least one vibrational device, and first and second control units that respectively control (a) the inflation and deflation of the at least one bladder and (b) vibrational device. The at least one bladder (i) inflates when receiving a fluid at a faster rate than the fluid exiting the bladder; (ii) deflates when the fluid leaves the bladder at a faster rate than the fluid entering the bladder, and (iii) has a top surface that allows a user to apply pressure thereon and a bottom surface. The vibrational device (a) is positioned (i) under the bottom surface of the bladder, or (ii) within the bladder and below the top surface of the at least one bladder so it does not contact the top surface; and (b) generates a vibrational force. The first control unit can adjust the inflation of the at least one bladder. The second control unit can adjust the vibration forces generated from the vibration device. The first and second control units can operate in conjunction with each other to provide the desired vibrational application to the user.

BRIEF DESCRIPTION OF THE INVENTION

FIG. 1 illustrates an isometric view of the present invention.

FIGS. 2*a-g* illustrates a cross-sectional view and alternative embodiments thereof of FIG. 1 taken along the lines 2-2.

FIG. 3 illustrates a cross-sectional view of FIG. 1 of FIG. 2*c* taken along the lines 3-3.

FIGS. 4*a-d* illustrate various electrical and/or fluid flow schematical embodiments of a first control unit.

FIG. 5 illustrates a plan level view of FIG. 3 taken along the lines 5-5.

FIGS. 6*a-b* illustrate various electrical and fluid flow schematical embodiments of a second control unit.

Figure 9A:
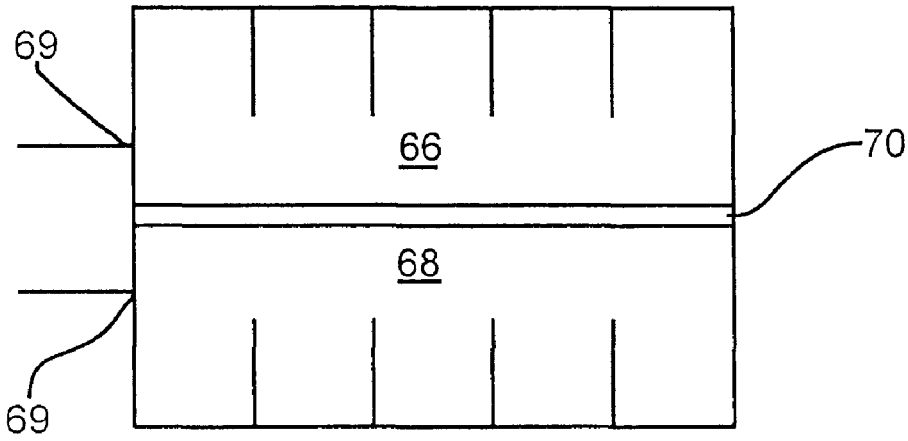
Figure 9B:
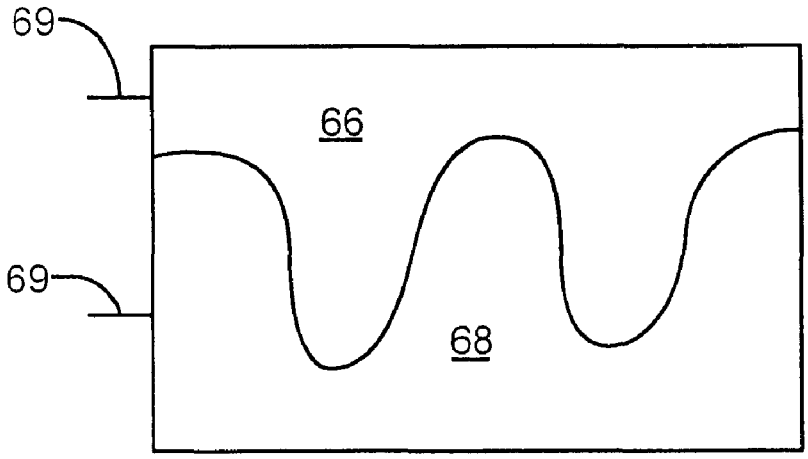

FIGS. 9*a-b* illustrate alternative embodiments of a vibrating pad.

DETAILED DESCRIPTION OF THE INVENTION

Figure 1:
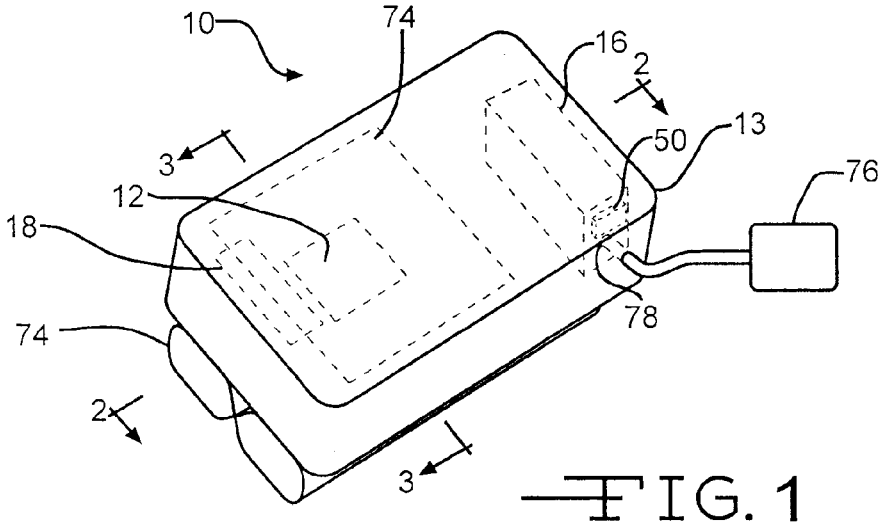

The present invention, as shown in FIG. 1, is directed to numerous mattress embodiments. One embodiment is directed toward a cushioning device 10, designed for bodies over 100 pounds, having a percussion/vibrational pad (hereinafter referred to as "vibration pad") 12, a first control unit 16, and a first bladder 14. These components are standard fare in inflatable vibrating mattresses. The critical aspect of this embodiment is that the vibrational pad 12 is positioned below the top surface of a bladder 14 to provide greater control of the vibration forces applied to the user on the cushioning device 10. Another embodiment is directed toward a swivel pendant device 50 used with a cushioning device 10. A third embodiment is directed to a mattress rotational system 74 for rotating a cushioning device 10, not directly rotating a user of the cushioning device 10. A fourth embodiment is directed toward a deep vein thrombosis unit 76 integrally associated with a cushioning device 10. A fifth embodiment is directed toward a second control unit system 18 to decrease pump size, noise, and vibrational forces from the control units, and increase the efficiency of the mattress system 10. A sixth embodiment is directed toward a variation of a vibration pad system 12. These and other embodiments will be disclosed in greater detail in this application.

The vibration pad 12 can provide both percussion and vibration characteristics. Which characteristic is generated depends on the number of beats per second that the vibration pad 12 generates. For example, and not to be limited to these examples, when a vibration pad 12 generates 1-7 beats per second that is generically described as percussion characteristics; similarly, then the vibration pad 12 generates more than 7, preferably 7 to 25 beats per second then that is generally referred to as a vibration characteristic.

A Greater Control Vibration Embodiment

The cushioning device 10 can be shaped like a mattress, a pad, a pillow, a mattress overlay, or any conventional cushioning device. As with many mattresses, the cushioning device 10 can have a cover 13, as illustrated in FIG. 1.

The cover 13 is an optional component of the present invention. The cover 13 can be any conventional material such as and not limited to natural fibers, polymeric materials, or combinations thereof. The cover could be a vapor permeable material, a low air loss material (a low air-loss bladder and/or manifold is sometimes desired because it allows the fluid, like air, to reduce the temperature below the patient, there is a decreased chance of skin maceration which lowers the risk of bed sores), or a complete barrier to any fluid penetrating the interior components of the device 10. Which type of cover material is used, is dependent upon the user's and/or owner's objective(s). If a cover 13 is used, it could provide some benefits to the user and possibly the owner of the device 10. One of these benefits is that a cover 13 is easier to clean than the components within the cover 13.

Figure 2A:
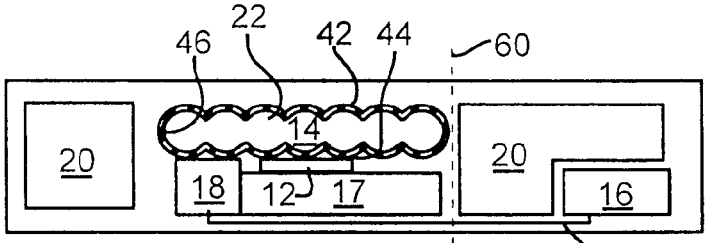

FIGS. 2*a-g* illustrate numerous and not exhaustive views of various cross-sectional embodiment views of FIG. 1 taken along lines 2-2. As illustrated in FIGS. 2*a-g*, the interior components of the device 10 comprises at least the first bladder 14, a first control unit 16, the vibratory pad 12 and a base cushion 17. The first bladder 14, the vibratory pad 12, and the base cushion 17 can be, and is preferably, positioned within a first aperture 22 of a frame 20. The frame 20 can be rigid or flexible. It can be made of conventional bedding frame material. Conventional bedding frame material includes and is not limited to foam, polymeric materials, metallic material, conventional mattress materials, gelastic materials, or combinations thereof. The first control unit 16 can also be positioned within the frame 20 and the cover 13, as illustrated in FIGS. 2*a* and *c*.

Figure 2B:
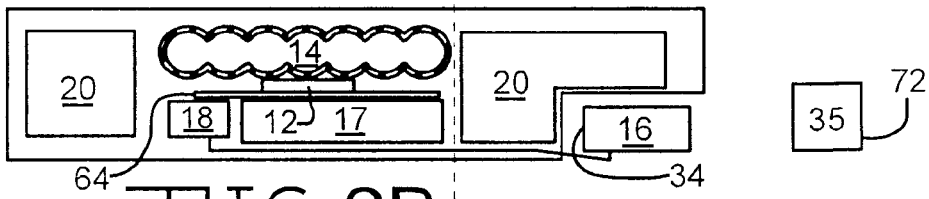

The first control unit 16 is preferred to be exterior to the frame 20 and the cover 13, as illustrated in FIGS. 2*b, d* and *e*. This position of the first control unit 16 is preferred because of numerous reasons. One of the reasons is that such a position makes the device 10 easier to clean. Another reason is that it allows the pendant to be repositioned. The latter reason will be explained in greater detail in a latter embodiment.

Figure 2C:
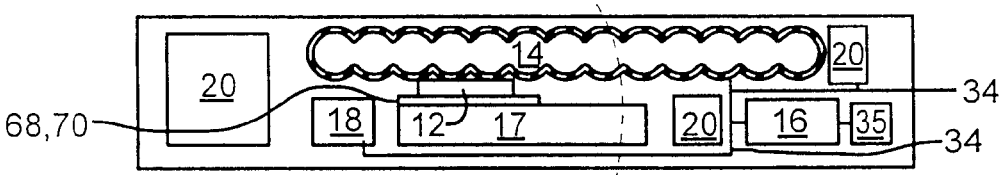
Figure 4A:
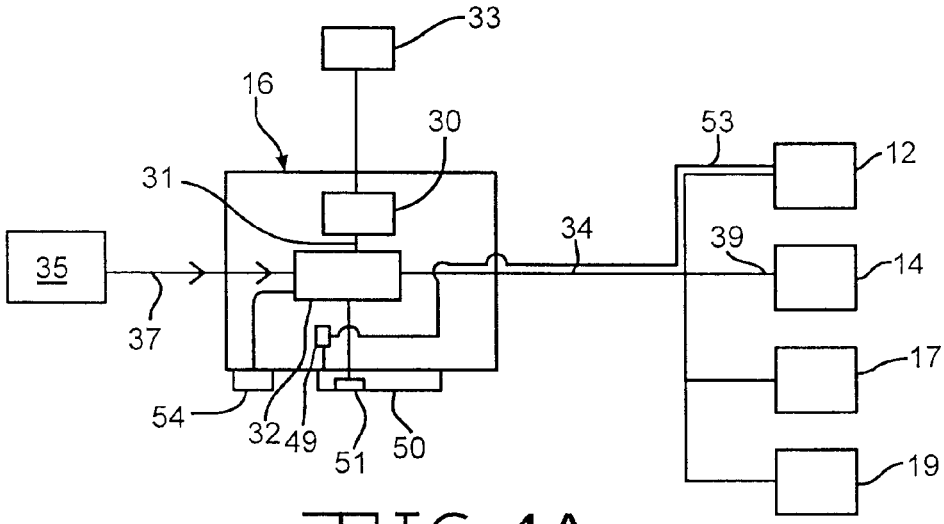

The first control unit 16 comprises at least a power unit 30 and at least a fluid control system 32, as illustrated in FIGS. 4*a-d*. The power unit 30 receives power from a power source 33, like a common electrical outlet. The power unit 30 provides power to at least the fluid control system 32 through conduit 31. The fluid control system 32 is capable of at least directing a fluid into at least a portion of conduit 34. The fluid is obtained from a reservoir 35. The reservoir 35 can be within the device 10, as illustrated in FIG. 2*c*, outside the device 10, as illustrated in FIG. 2*b*, or surrounding a bladder, as shown in FIG. 2*g* for a third bladder 48 with a second reservoir 35*a*. If the reservoir 35 is outside the device 10, the reservoir could be (1) the natural environment (air), or (2) a container having any gas or liquid, with a conduit 37 (as shown in FIG. 4*a*) between the reservoir 35 and the fluid control system.

The fluid control system 32 can be a conventional device, like a pump, that can draw the fluid from the reservoir 35 into the at least a portion of conduit 34. Conduit 34 can be a single unit or a plurality of units that transport the fluid and/or power to the respective components of device 10. In any embodiment, the fluid is directed toward the respective bladders designed to receive a fluid. One of those respective bladders is the first bladder 14, and if the vibrational pad 12 and the base cushion 17 are designed to receive a fluid then those components also receive the fluid.

The first bladder 14 can be any conventional inflatable bladder. It can have an inlet 39, see FIG. 4*a*, and an outlet, or the inlet and the outlet can be the same, to receive a fluid. As stated above, the fluid can be a gas or a liquid. A preferred gas is air and a preferred liquid is water, even though water has a known limited frequency it and other liquids can be used in the present invention. Since the first bladder receives such fluid, the first bladder must be made of a material that can contain such fluid. Depending on the type of fluid received, the bladder can be made of various conventional materials. Such conventional materials include and are not limited to natural fiber materials, polymeric materials, or combinations thereof. A fundamental principle of the bladder material is that it be made of material that can withstand the fluid pressure and the pressure applied by an outside source, like a user lying thereon. Preferably, the bladder 12 is a polymeric resin material.

Figure 3:
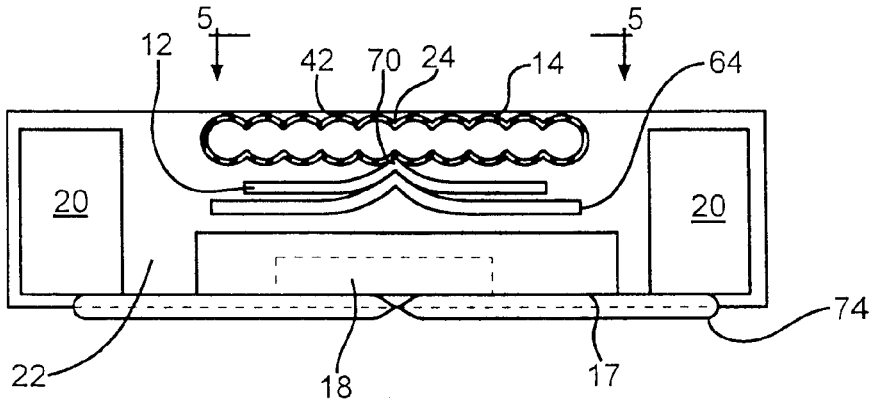

In a preferred embodiment, the first bladder 14 has a center line 24, as illustrated in FIG. 3. The center line 24 can be a welded portion of the bladder 14, or a series of button welds. In any case, the center line 24 can traverse the entire length of the first bladder 14 or just a portion thereof. The length of the centerline 24 is determined by the application of the device 10. One reason for having a center line is to secure the vibration pad 12 and possibly other components in place. The basis for this reason will be explained later in this application.

In an alternative embodiment, the first bladder 14 contains conventional support elements 40, which could also be referred to as barriers. These support elements are commonly used in bladders to provide additional support to the bladder when a user lies thereon to decrease bottoming out or creeping of inflatable bladders. If these supports elements 40 are used, they should not apply extra pressure to the user. In the present invention, the support elements 40 can be used to position the vibrational pad 12 within the first bladder 14, as shown in FIG. 2*g*.

Figure 8:
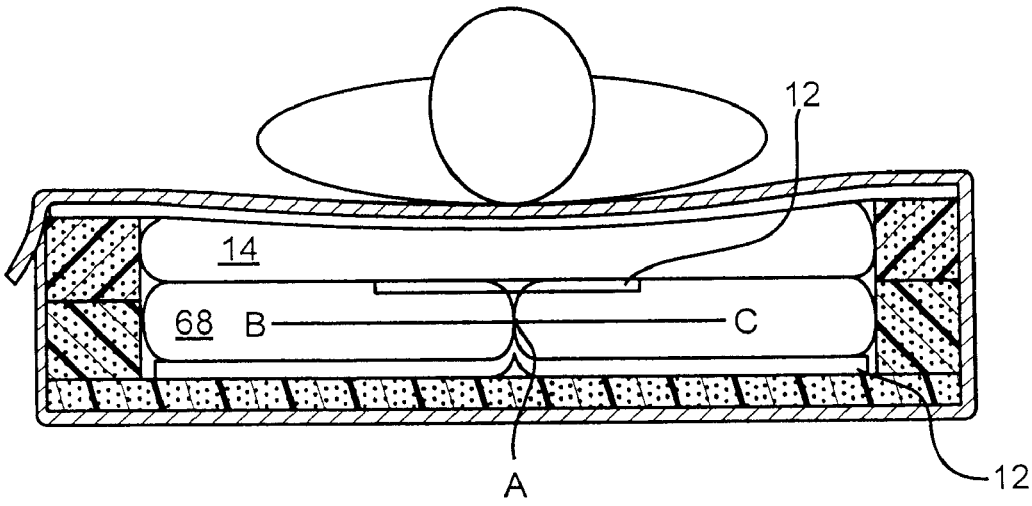
FIG. 8 is an alternative embodiment of the present invention.

Whether the bladder 14 has the preferred center line 24, the supports 40, or not, the bladder 14 can have a conventional bladder design. Conventional bladder designs include and are not limited to dynamic bladders (able to be inflated, deflated or maintain status quo of inflation); low air-loss bladders (apertures in the bladder and/or manifold that allow fluid to escape and depending on the location of the apertures the fluid may or may not contact the user); rotational bladders as illustrated and described in commonly assigned U.S. Pat. No. 5,926,883 which is hereby incorporated by reference; bladders that extend the width of the mattress, bladders that extend the length of the mattress, bladders that extend at angles across the length and width of the mattress and/or combinations thereof. If bladder 14 is a rotational bladder system, those rotational bladders, as described in the '883 patent, allow the patient to be rotated to various angles, such as 45 degrees relative to point A on plane B-C, as shown in FIG. 8.

The first bladder 14 also has, as shown in FIG. 2*a*, a top surface 42 that supports the user to decrease the development of pressure ulcers. The bladder 14 has a bottom surface 44 which is opposite the top surface 42 and separated from the top surface 42 by a side surface 46.

The vibrational pad 12 can be any device able to provide a vibrational or percussion force to a user of the device 10. For example, the vibrational pad can be controlled pneumatically, electrically, or powered by natural fuels. The pad 12 can generate a frequency vibration of any desired amplitude and/or frequency. The vibrational force of the pad 12 can generate a pulsating wave, a variable frequency wave, a steady wave, a variable amplitude wave, a step wave, or any other conventional wave.

An example of such electrically powered vibrational pad is a conventional mechanical vibrating object. Such mechanical devices are, however, not preferred in the present invention. Instead, the preferred embodiment of the vibration pad 12 is capable of receiving a fluid and operating pneumatically. That preferred embodiment is explained in greater detail later in this application. When vibrational pads 12 operate, those pads generate a force, vibrational and/or percussion, in response to an electrical signal generated by at least a vibrational control unit 49.

Figure 4B:
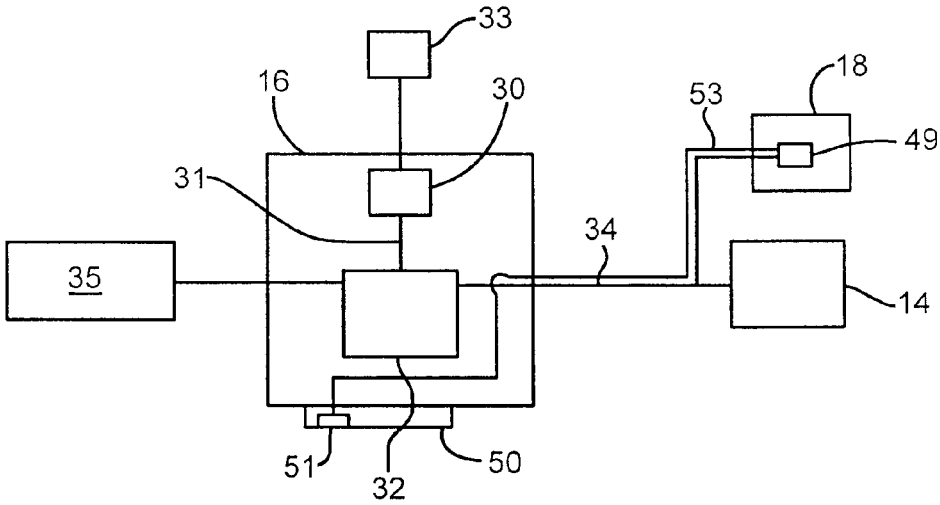
Figure 4C:
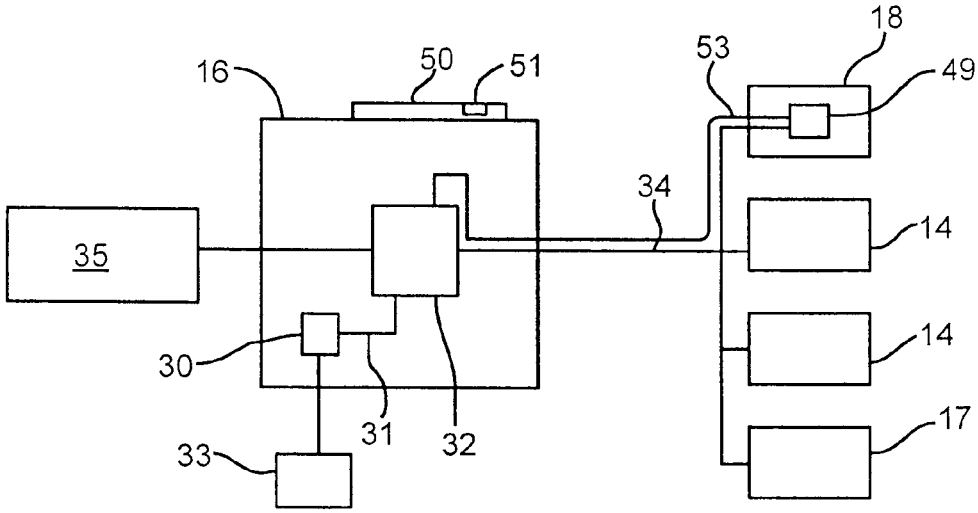
Figure 4D:
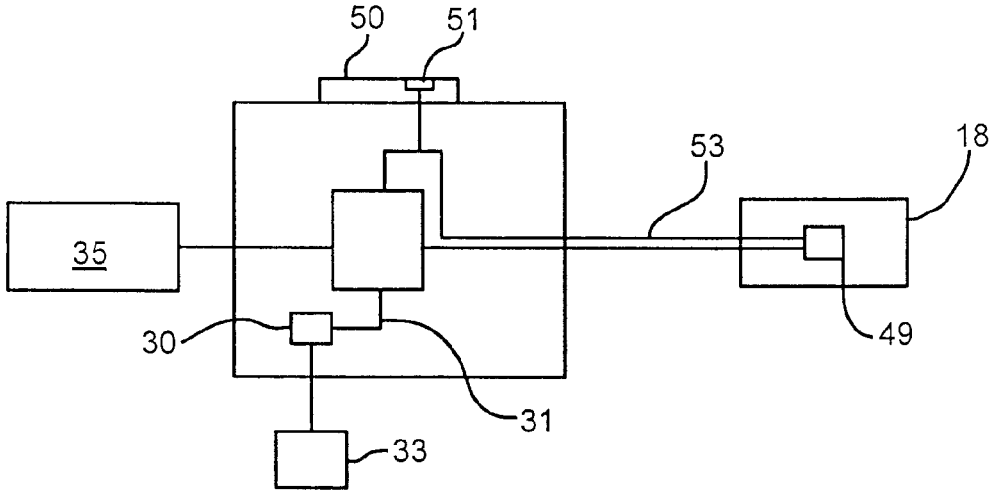

The location of the vibrational control unit 49 can be associated with the first control unit 16 as shown in FIG. 4*a* or the second control unit 18 as shown in FIGS. 4*b-d*. The vibration control unit 49 can be programmed and/or controlled by a user and/or third party to generate the desired force. The user and/or third party can input the value of a desired force to be generated by the vibration pad 12 through a keypad, knob, or similar control device 51 on a pendant 50 that is a component of the first control unit 16. The pendant 50 transmits an electrical signal 53 corresponding to the desired vibration value directly or indirectly (discussed later) to the vibrational pad 12 through one of the units of conduit 34, as shown in FIGS. 4*a-d*. The pendant 50 is powered through power unit 30, as well.

The user and/or third party is also able to control and/or monitor through the pendant 50 the inflation of the first bladder 14. The user can program the desired inflation of the first bladder by inputting values through device 51 of the pendant 50 that correspond to the desired inflation of the first bladder 14. The pendant 50 then transmits the desired inflation value to the fluid control system 32. The fluid control system 32 in response to the inflation value directs a corresponding amount of fluid to the first bladder 14 to obtain the desired inflation, deflation, or status quo of fluid in the bladder 14.

For this embodiment of the present invention, the position of the vibrational pad 12 is critical. It is critical because this embodiment of the invention is directed to controlling the vibration forces applied to the user on the device 10. The vibrating pad 12 is positioned below the first bladder's 14 upper surface 42 and is designed not to contact the upper surface 42 when vibrational pad 12 is operating, and when positioned below the first bladder 14.

Figure 2D:
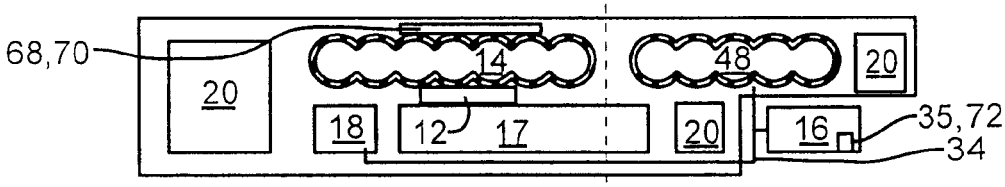
Figure 2E:
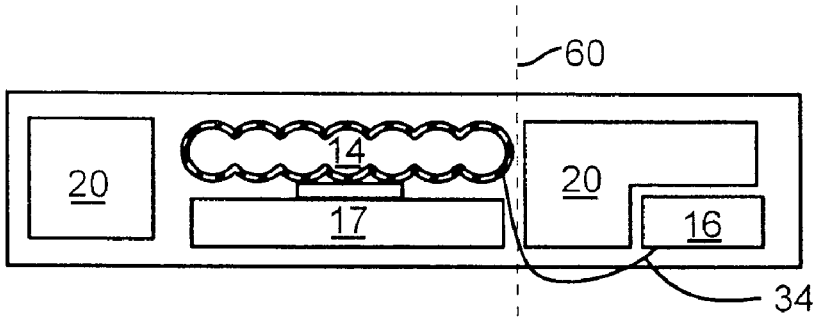
Figure 2F:
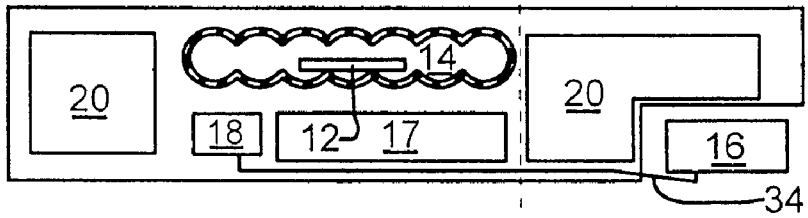
Figure 2G:
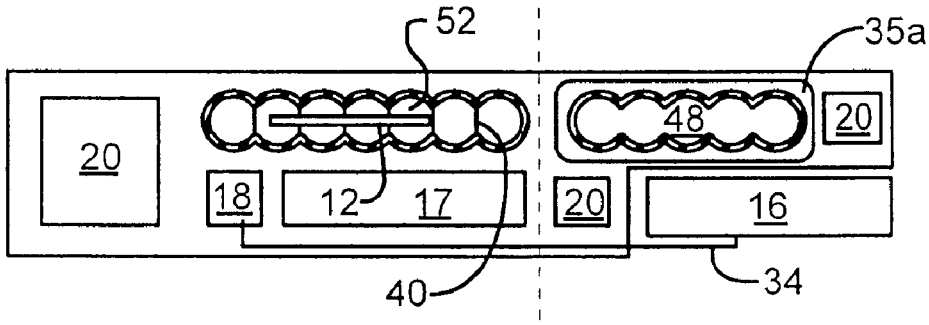

This objective is accomplished by securing the vibrating pad 12 on supports 40, as illustrated in FIG. 2*g*; on the bottom or side surfaces of the interior of the first bladder 14, as illustrated in FIG. 2*f*; below the first bladder 14, as illustrated in FIGS. 2*a-e*. This objective can also accomplished by attaching the vibrating pad 12 to the center line 24.

The design of having the vibrational unit below the upper surface 42 is critical for the present invention, for example, to avoid applying too much vibrational force to the patient. To initiate the vibration of the device 10, it is desired that the at least one bladder 12 associated with the vibrating device 14 be controllably deflatable and/or inflatable. Controllable deflation can occur through many means. Such means include and are not limited to the fluid control system 32 and corresponding pendant 50, and a CPR dump mechanism 54, as shown in FIG. 4*a*. Both means can dump all or a predetermined portion of the fluid from the first bladder 14 or only the fluid from the bladders positioned above the vibration device 12. The electrical components to controllably deflate and inflate such particular bladders 12 are well known in the art, as described generically above.

The CPR dump mechanism 54 can be any type of apparatus that rapidly depletes the fluid from any and all fluid containing bladders in the device 10. There are numerous embodiments of CPR dump mechanisms 54 that are known to those of ordinary skill in the art. In any case, a CPR dump mechanism is used to put the user on a non-fluid surface as fast as possible. Once on a non-fluid surface, someone can effectively perform CPR on the user. Alternatively, the first bladder 14 can be inflated to its maximum level for performing CPR on a patient. By maximizing the inflation, the bladder is equivalent to a hard surface. If this alternative method is used, it may be advisable to utilize a conventional CPR backboard between the patient and the bladder 14.

Such knowledge for controllable deflation and inflation, however, has been previously used for different purposes. Such purposes include and not limited to rotating a patient, and alternating the inflation of sets of bladders to create a wave-like motion to the user. Accordingly, such controllable inflation/deflation is known, but it has, according to the applicant's knowledge, never been used for the purpose of controlling the vibrational forces applied to a patient.

As previously stated, Hand et al. disclose that vibrational forces from a vibrational device are merely controlled by altering the frequency of the device through its control unit. The present invention, however, is able to provide greater control of the vibrational forces than previously obtained—through inflation control and vibration control.

The vibrational forces sometime need to be further adjusted than what is available through just a mere control unit, like that disclosed by Hand et al. To obtain this further control, applicant has devised a system of inflating or deflating at least the first bladder 14 associated with the vibrating pad 12. By adjusting the inflation or deflation of the bladder 14, the vibrational forces can be controlled with greater accuracy than previous vibrational devices. Moreover, by moving the vibrational device 12 below or within (without contacting the upper surface 42) the bladder 14 and controlling the inflation of the bladder 14, the vibrational pad 12 can be better controlled than prior vibrating cushions. Hence, the vibrational device 12 will be able to provide the desired frequency and amplitude of vibrational forces to the user.

Placing the vibrating pad 12 adjacent to or contacting the upper surface 42 is to be avoided while the pad 12 is operating and a user is on the device 10. It is to be avoided to prevent the vibrational pad 12, while vibrating, from being in direct contact with the patient. Indirect vibrational forces are desired in the present invention to have greater control of the forces that are applied to the patient.

A Double Control Unit Embodiment

The fluid does not always go directly to the vibrational pad 12. Instead, the fluid may be directed toward a second control unit 18, as illustrated in FIGS. 4*b-d*, and 2*a-d* and *f-g*. The first control unit 16 is designed to be positioned at the foot 26 of the device 10, and the second control unit 18 at the head 28 of the device 10. The first control unit 16 is designed to receive the device's power and provide the necessary fluid for the entire device 10. The second control unit 18 is designed to decrease the size of the components in the first control unit to decrease vibration and noise generated from the control unit 16 of the device 10. To obtain these objectives, the second control unit 18 has secondary units that assist distribute the power and fluid to the desired bladders and devices contained in the device 10.

Figure 6A:
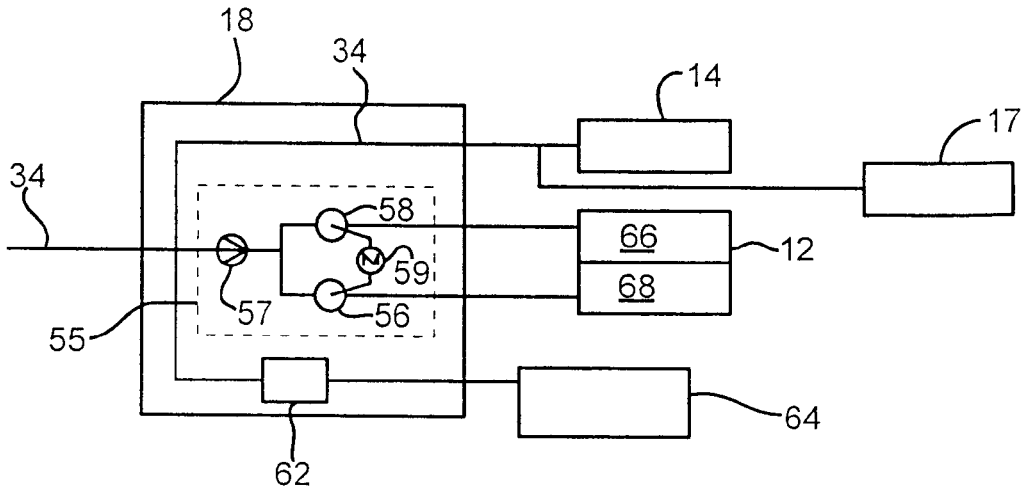

For an embodiment of the vibrating pad 12 which will be discussed below, the second control unit 18 must have at least a double diaphragm system 55, as illustrated in FIG. 6*a*, or a single diaphragm system (not shown). The double diaphragm system 55 has a valve unit 57, a first diaphragm unit 56 and a second diaphragm unit 58. The double diaphragm system 55 has a motor 59 that applies alternate pressure, like a piston system, applied to the respective first and second diaphragm units 56, 58. Obviously, the single diaphragm system has a single unit that can distribute the fluid to at least a single chamber, and possibly more chambers, of a vibration device 12.

The valve unit 57 is interconnected to receive fluid from one of the units of conduit 34. The valve unit 57 allows a predetermined amount of fluid to pass therethrough. Once that predetermined amount is obtained, the double diaphragm system 55 receives no more fluid until the fluid volume is decreased. The fluid passes through the valve unit 57, through conduits, to the first and second diaphragm units 56, 58.

Figure 5:
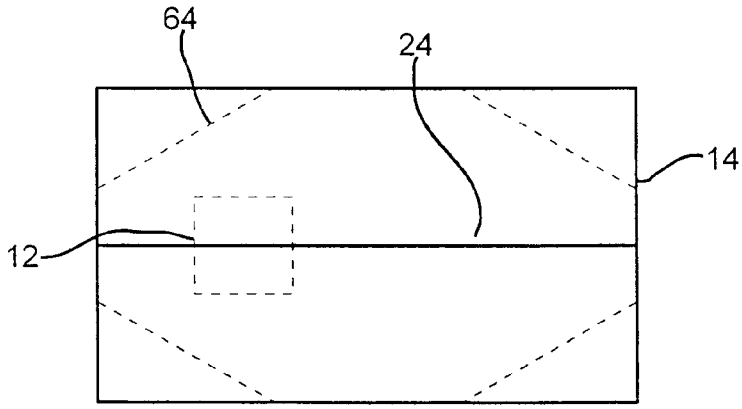
Figure 6B:
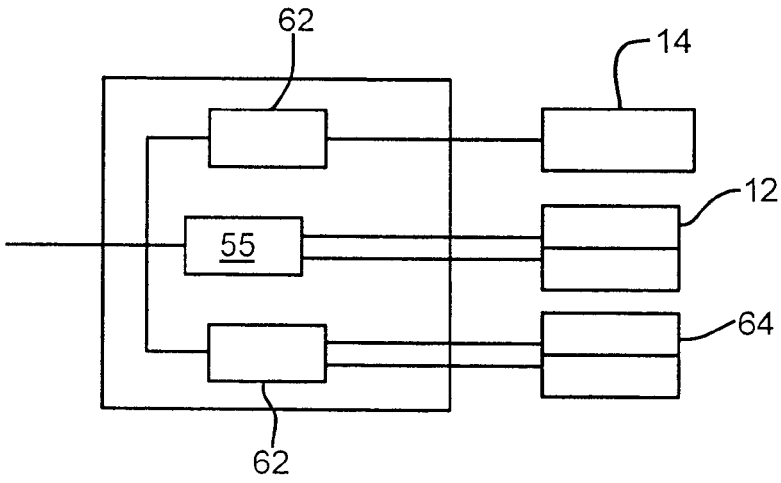

The second control unit 18 may also contain other conventional fluid distribution system(s) 62 for distributing fluid to any bladder positioned between the head section 28 and an arbitrary demarcation line 60 located between the head and the foot sections of device 10. See dotted line 60 in FIGS. 2*a-g*. The fluid distribution systems 62 may be a conduit, a plurality of conduits, a single pump with various conduits to each inflatable bladder (FIG. 6*a*), multiple pumps (FIG. 6*b*) wherein each pump could have (i) a single conduit to a single inflatable bladder or numerous inflatable bladders, or (ii) a plurality of conduits extending therefrom to single inflatable bladder or numerous inflatable bladders. Obviously, the options are numerous and it depends on how the device 10 is to be used. Another example of the numerous options are, and not limited to, there could be a conventional pump system for providing fluid to first bladder 14, and a conventional rotating bladder pump system for a rotating inflatable bladder 64 (see FIGS. 2*b* and 5) positioned below the vibrating pad 12 and within cover 13. These fluid distribution systems 62 are preferably designed for providing fluid to inflatable bladders that are positioned above the demarcation line 60, as suggested in FIGS. 4*b*-4*d*.

If any bladders extend between the foot section and the demarcation line, the fluid control system 32 may provide the fluid directly to those bladders, as suggested in FIGS. 4*a-c*.

There are numerous reasons for having two distinct control units, other than the reasons set forth above. One of those reasons is that it diminishes the chances of the conduits kinking. As suggested above, the fluid and power is generated in the first control unit 16. The first control unit combines all the conduits that direct fluid and power for all components positioned exclusively (and possibly, non-exclusively) between the head section and the demarcation line. By combining those conduits to the second control unit 18, there is a decreased chance of kinking. Moreover, by diminishing the number of conduits extending to the various bladders from the first control unit 16, cleaning the device 10 becomes easier. It becomes easier to clean because there are fewer components to detach and re-attach.

A Vibrating Pad Embodiment

A variation of a vibrating pad 12 has at least a first chamber 66 and a second chamber 68, as shown in FIGS. 6*a,b* and 9*a,b*. Each chamber 66, 68 has an inlet/outlet 69 that allows fluid to flow into and out of each chamber from corresponding first and second diaphragm units 56, 58. In synopsis, the first chamber 66 inflates from the first diaphragm unit 56 while the second chamber 68 deflates from the second diaphragm unit 58; or alternatively, both chambers 66, 68 inflate and deflate simultaneously. Obviously, this process is reversible so that the vibrating pad 12 can create the desired vibrating/pulsating force. The shape of each chamber 66, 68 can be have various designs—serpentine (FIG. 9*b*) with or without constricted paths, fingers (FIG. 9*a*) with or without constricted paths, button welds, welds, or combinations thereof to obtain the desired effect.

If this embodiment of the vibrating pad 12 is used, the vibrating pad 12 may have a center line 70 that separates the first chamber 66 from the second chamber 68. That center line makes it extremely convenient to attach, and thus secure, center line 70 to center line 24 as illustrated in FIG. 3. That way the vibrating pad 12 and the first bladder 12 are securely attached to each other. Obviously, the vibrating pad 12 can also be attached to the interior of bladder 12, as discussed above. And if so, the attachment can still occur at center line 24, as discussed above.

If the vibratory pad 12 receives a fluid, the vibratory pad 12 must (1) have (i) an inlet and an outlet or (ii) an inlet and outlet that are the same, and (2) be made of a material that can receive a fluid. Examples of such materials are the same as used with the bladder 12.

Base Embodiment

Below the vibrating pad 14 (FIGS. 2*a-e*) and/or the combined vibrating pad 12/first bladder 14 (FIGS. 2*f-g*), there can be numerous bladders. One of the bladders can be a conventional rotating bladder system 64, which has been discussed above. Another of the bladders can be a base cushion 17. The base cushion 17 can be any type of cushion device. Examples of such cushion devices include and are not limited to Gaymar's Symmetric Aire™ cushion, a second first bladder, a gelastic product, foam, or variations and combinations thereof that are preferably distinct from the frame 20 material.

The third bladder 48, as illustrated in FIG. 2*d*, can be the same components, but obviously different components, as the second bladder 17. The third bladder 48 can be positioned over the first control unit 16 and a portion of the cover 13.

Another embodiment of the present invention has wave bladders 68, as illustrated in FIGS. 2*c* and *d*, positioned (1) between the bladder 14 and the vibrational device 12, (2) between the vibrational device 12 and the bottom of device 10, (3) between the bladder 14 and the bottom of the device 10, and (4) between the bladder 14 and the top of device 10. The wave bladders 68 have at least two sets of bladders, and are well known to those having ordinary skill in the art. Each set of bladders 68 can be interconnected to the other bladder or overlay the other set of bladders. In any case, one set of bladders are designed to inflate and simultaneously, or alternatively in a desired time frame, the other set of the bladders are to deflate. These bladders can be alternated in any predetermined order, for example the first four bladders and then the next four bladders or any other desired combined and/or operation. Thereby, the bladders 68 create a wave motion to the user positioned on the device 10.

In another alternative embodiment, a temperature pad 70 can be positioned above, or alternatively within or below, the bladder 14. The temperature pad 70 can receive a fluid of any desired temperature. That means, the temperature pad can heat, cool or maintain the temperature of the patient positioned on the device 10. The fluid can be a gas or a liquid. Preferably, the fluid is a liquid and the temperature is controlled by a Medi-Therm® unit. The temperature pad 70 can even be a conventional electric blanket or a cover that is electrically conductive and can generate desired and sufficient thermal energy. In any case, the heating element is designed to dilate a user's bronchial passages. This allows the mucous to break up, which is assisted by the vibrator 12. The mucous can then be easily expelled from the user.

Temperature Control

Notwithstanding the temperature pad 70, the present invention can alter the fluid's temperature to any desired temperature. This can be accomplished through an appropriate fluid temperature device, like Gaymar's Medi-Therm unit. An example of such a device is illustrated in expired U.S. Pat. No. 4,091,804.

In some cases, the reservoir 35 or the first control unit 16 may be or contain such a fluid temperature controlling device 72, as shown in FIGS. 2*b* and *d* (tubing interconnecting the device 72 to unit 10 is not shown), that is able to alter the temperature of the fluid to a desired temperature. The desired temperature could range from 4° to 45° C. As for controlling the temperature of a gas, the present invention can use any conventional heating and/or cooling apparatus that controls a gas' temperature. In addition, the pump system 32, 32*a* or other systems can distribute the fluid to various bladders.

Controlling the Fluid Pressure

There are numerous conduits used in the device 10 that direct a fluid to a respective device. The pressure of the fluid can be controlled in numerous conventional methods. One of those methods is the inner diameter of the conduits, which could be different for each bladder. Another method is to control the flow rate of the fluid from the various pumps or diaphragms. All of these various fluid pressure controls and other conventional methods can be utilized throughout the device 10 when desired.

Rotating Mattress Embodiment

Below the cover 13, or below the above-identified interior components of device 10 which includes elements 12-70 (excluding element 35 when outside the device 10) is a mattress rotating bladder 74, as shown in FIGS. 1 and 3. The mattress rotating bladder 74 is equivalent to any conventional rotating bladder, except it is positioned below the mattress 10. By being positioned below the mattress 10, the mattress rotating bladder 74 rotates the mattress 10, not the user per se. Due to increased weight, the mattress rotating bladder 74 is unable to rotate as great as a conventional rotating bladder, as described above, but it still operates in the same conventional manner. An advantage of using a mattress rotating bladder is that the pressure exercised upon the patient can be further decreased. In addition, the combination of the rotating bladders used in device 10 and the mattress rotating bladder can provide greater rotation, and less pressure exerted on the user.

Deep Vein Thrombosis Cuff

Figure 7:
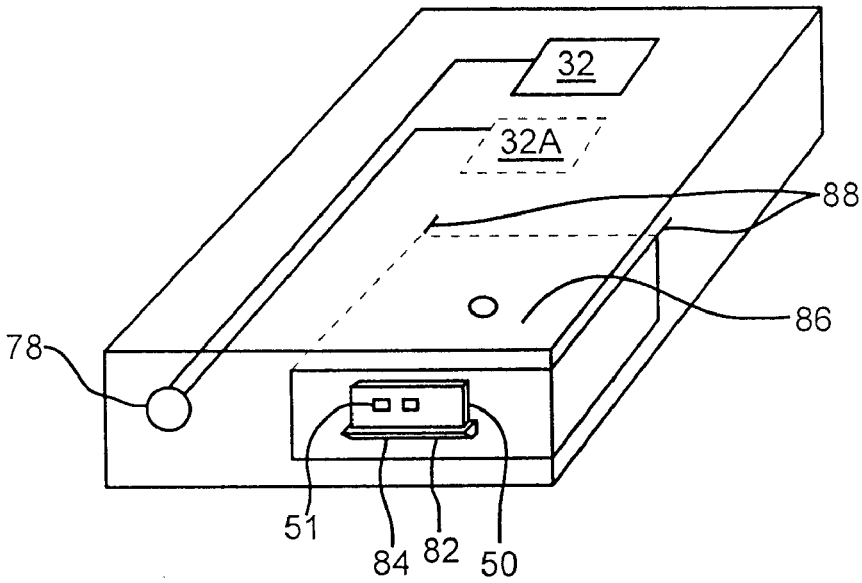
FIG. 7 illustrates an alternative embodiment of the first control unit.

There are numerous types of deep vein thrombosis cuffs 76. An example of one such a device is described and illustrated in commonly assigned expired U.S. Pat. No. 4,597,384. The cuff 76 is designed to be interconnected to a fluid source. The fluid source is normally distinct from the mattress unit. To decrease unnecessary instruments around the mattress 10, the cuff 76 can be interconnected to at least one outlet 78 of the first control unit 16, in particular the fluid control system 32, or a second fluid control system 32*a*, as shown if FIG. 7. The second fluid control system 32*a* is operated and controlled in a similar method, through the pendant 50, as the fluid control system 32. As such, the cuff can be provided with the same or different fluid pressure as the bladders 12 receive, or two distinct fluid pressures to obtain a desired fixed sequential, graduated sequential, or lymphedema pressure system. The cuff can then be applied to the user in the conventional method.

Swinging or Movable Pendant

The pendant 50 is a conventional pendant. It can be removeably attached or permanently attached to the first control unit 16. By removably attached, we mean the pendant can be a remote control unit (normally undesired in hospital settings), tethered to the first control unit 16, or removable so the pendant 50 can be programmed and when it is properly repositioned onto a handle 82, as shown if FIG. 7, (like a mother-daughter board interconnection) of the first control unit 16, the pendant 50 can control the mattress. These are just some methods in which a pendant 50 can operate with the device 10.

In many cases, the pendant is limited to a particular position on the first control unit 16. Such limitations may be undesired to the owner of the device 10 because of the position of the device 10 in a room, or the use of bed rails and the like. Accordingly, applicant has devised a unique method to provide the user with options for the placement of the pendant and/or the handle 82 for the pendant 50 (hereinafter collectively referred to as the "control station" 84).

The first control unit 16 is a conventional box-like device with a top surface, a bottom surface and at least four sides positioned between the top and bottom surfaces. Two of the sides and a corresponding corner act like a lazy-susan turntable 86. This lazy-susan turntable has at least three sides and one of the sides contains the control station 84. It is preferred that the lazy-susan has at least one stop-position mechanism 88 that prevents the lazy-susan turntable 86 from hitting the control station 84.

It is possible that the lazy-susan turntable 86 can be positioned on either side of the device 10.

While the preferred embodiment of the invention has been illustrated and described, it will be clear that the invention is not so limited. Numerous modifications, changes, variations, substitutions and equivalents will occur to those skilled in the art without departing from the spirit and scope of the present invention as defined by the appended claims.

We claim:

1. A rotating patient support system comprising:

a patient support system within a cover, and within the cover the patient support system has at least one bladder that inflates upon receiving the fluid at a greater rate than fluid exiting the bladder, deflates when the fluid leaves the bladder at a faster rate than fluid entering the bladder, and has a top surface that allows a user to apply pressure thereon and a bottom surface; and a first control system capable of adjusting the volume of fluid in the at least one bladder;

a rotational bladder system beneath the patient support system and the cover so at least a portion of the patient support system rotates; and wherein the patient support system further comprises a vibrational device positioned below and not contacting the top surface of the at least one bladder and generates a vibrational force;

wherein when the vibrational device is generating a vibrational force, the first control unit does not allow the at least one bladder to become deflated to a point wherein the vibrational device contacts the user.

2. The system of claim 1 having a compression sleeve interconnected to the first control system.

3. The system of claim 1 wherein the patient support system further comprises a second control unit capable of adjusting the vibration forces generated from the vibration device.

4. A patient support system comprising:

a patient support system, the patient support system has at least one bladder that inflates upon receiving the fluid at a greater rate than fluid exiting the bladder, deflates when the fluid leaves the bladder at a faster rate than fluid entering the bladder, and has a top surface that allows a user to apply pressure thereon and a bottom surface; and a first control system capable of adjusting the volume of fluid in the at least one bladder, with a compression sleeve interconnected to the first control system.

5. The system of claim 4 further including a cover, and wherein the patient support system and the at least one bladder are within the cover.

6. The system of claim 5 further including a rotational bladder system beneath the patient support system and the cover so at least a portion of the patient support system rotates.

7. The system of claim 4 further including a frame and a rotational bladder system with the rotational bladder system being beneath the frame and the patient support system so at least a portion of the patient support system rotates.

8. The system of claim 4 wherein the patient support system further comprises a vibrational device positioned below and not contacting the top surface of the at least one bladder and generates a vibrational force;

wherein when the vibrational device is generating a vibrational force, the first control unit does not allow the at least one bladder to become deflated to a point wherein the vibrational device contacts the user.

9. A rotating patient support system comprising:

a patient support system having a frame within a cover, and within the cover the patient support system has at least one bladder that inflates upon receiving the fluid at a greater rate than fluid exiting the bladder, deflates when the fluid leaves the bladder at a faster rate than fluid entering the bladder, and has a top surface that allows a user to apply pressure thereon and a bottom surface; and a first control system capable of adjusting the volume of fluid in the at least one bladder; and a rotational bladder system beneath the patient support system and the cover so at least a portion of the patient support system rotates.

10. The system of claim 9 having a compression sleeve interconnected to the first control system.

11. The system of claim 9 wherein the patient support system further comprises a vibrational device positioned below and not contacting the top surface of the at least one bladder and generates a vibrational force;

wherein when the vibrational device is generating a vibrational force, the first control unit does not allow the at least one bladder to become deflated to a point wherein the vibrational device contacts the user.

12. The system of claim 11 wherein the patient support system further comprises a second control unit capable of adjusting the vibration forces generated from the vibration device.

* * * * *